US005989018A

United States Patent [19]

Ahvenainen

[11] Patent Number: 5,989,018

[45] Date of Patent: Nov. 23, 1999

[54] LIME SLUDGE FEED ARRANGEMENT

[75] Inventor: Arto Ahvenainen, Varkaus, Finland

[73] Assignee: Ahlstrom Machinery Oy, Helsinki, Finland

[21] Appl. No.: 08/886,403

[22] Filed: Jul. 1, 1997

[30] Foreign Application Priority Data

Jul. 5, 1996 [FI] Finland ..... 962777

[51] Int. Cl.[6] ..... F27B 7/36

[52] U.S. Cl. ..... 432/109; 432/103; 432/106; 432/14

[58] Field of Search ..... 432/103, 105, 432/106, 107, 109, 112, 114, 82, 14

[56] References Cited

U.S. PATENT DOCUMENTS

| | | | |
|---|---|---|---|
| 3,603,569 | 9/1971 | Abboud . | |
| 4,255,131 | 3/1981 | Johnson, Jr. | 432/106 |
| 5,110,289 | 5/1992 | Mattelmaki . | |
| 5,213,496 | 5/1993 | Avhenainen . | |
| 5,558,432 | 9/1996 | Swisher, Jr. | 432/109 |
| 5,673,748 | 10/1997 | May et al. | 432/107 |
| 5,746,590 | 5/1998 | May et al | 432/114 |

FOREIGN PATENT DOCUMENTS

| | | |
|---|---|---|
| 369650 | 5/1990 | European Pat. Off. . |

*Primary Examiner*—Philip H. Leung
*Assistant Examiner*—Jiping Cu
*Attorney, Agent, or Firm*—Nixon & Vanderhye P.C.

[57] ABSTRACT

A method and apparatus for supplying lime sludge to a rotary kiln guides the flow of the lime sludge into the kiln, and the flow of flue gases out of the kiln, in distinct paths so that contact between the lime sludge entering the kiln and flue gases exiting the kiln is substantially prevented. This is typically accomplished by providing a general horizontal tubular duct interiorly of the kiln first end and extending into a substantially vertical flue gas conduit with an annular chamber defined between an outer surface of the tubular duct and an inner surface of an inlet to the first end of the rotary kiln. The lime sludge is introduced into the annular chamber. Spiral feeding blades are preferably provided on the outer surface of the tubular duct and the duct rotates with the rotary kiln so that the spiral feeding blades engage the lime sludge and move it toward the kiln. The lime sludge is preferably dried before it is fed into the annular chamber. Different types of baffles may be provided at a top portion of the annular chamber to cause any flue gas which enters the annular chamber to exit it, and flow into the vertical flue gas conduit, adjacent a bottom portion of the annular chamber.

22 Claims, 5 Drawing Sheets

LIME SLUDGE FEED ARRANGEMENT

BACKGROUND AND SUMMARY OF THE INVENTION

The invention relates to a method and apparatus for treating lime sludge, and a particular configuration of a rotary lime kiln. Lime kilns and associated equipment for supplying lime sludge to the lime kiln, are standard and important pieces of equipment in the production of cellulose pulp. A lime kiln is part of the pulp mill chemical recovery plant, the lime being used for causticizing green liquor to produce white liquor in the production of kraft pulp.

Lime sludge is a sludge of calcium carbonate produced in the causticizing plant of a sulphate pulp mill. The lime sludge ($CaCO_3$) is regenerated by reburning it to form calcium oxide (CaO). The reburning takes place in an ordinary rotary kiln, into the upper end of which the lime sludge is supplied. The sludge flows slowly downwardly through drying, heating and reaction zones. Conventional rotary kilns desirably enhance the heat transfer from the flue gases and the lime sludge in the drying zone by providing chains which rotate with the kiln and come into contact with the lime sludge during that rotation. In order to obtain proper results the heat treatment of lime sludge typically takes place slowly in the kiln, meaning that the kiln must be long and therefore takes up significant floor space or land area.

Prior to feeding the lime sludge to the kiln, the sludge is usually dried using mechanical filters. Conventionally the lime has been dried to a dry solids content of between about 60–70%, but using most modern technology a dry solids content of between about 80–90% may be obtained. When sludge having a dry solids content of about 80–90% is used, the dust content of the flue gases of the kiln rises significantly. The moving chains in the kiln detach the dry sludge more easily than less dried sludge, thus causing entrainment of the larger volume of the lime in the flue gases. This also can result in a higher exhaust temperature of the flue gases, which can have problems associated therewith, and desired reduction in fuel consumption in the rotary kiln is not achieved.

One prior art method for eliminating the problems associated with chains used in the rotary kiln, and to allow a shorter kiln, is a suspension-type drying system. In such systems lime sludge is introduced into a substantially vertical conduit through which the flue gases from the kiln move upwardly at a relatively high rate of speed. Most of the lime is entrained in the upwardly moving gas, and dried by contact therewith, and the flue gas with entrained particles is fed to a conventional separator (such as a cyclonic separator), the flue gases being discharged and the lime particles—which now have been dried—being fed to the inlet to the lime kiln. A baffle may be provided which allows lime sludge to be dried in the suspension dryer, fed directly to the kiln, or both, depending upon the dry solids content and particle size of the lime sludge. Such a system is shown in U.S. Pat. No. 5,213,496, the disclosure of which is hereby incorporated by reference herein. Such systems—namely combinations of suspension-type dryers and rotary kilns—are replacing rotary kilns per se in the marketplace because the combination of a suspension-type dryer and rotary kiln provides high heat capacity and good heat economy. Capacity and heat economy of such a combination may be further improved by employing two subsequent suspension drying stages, one of which serves as a dryer per se, the other acting as a preheater. The flue gases from a kiln are first taken to a suspension preheater and from there to the dryer. The lime sludge to be dried is supplied from a lime sludge filter to the dryer, then to the preheater, and finally to the kiln to be combusted therein.

A common problem in such systems is that since the dried lime sludge to be burned is introduced into the same end of the rotary kiln from which the flue gases are discharged, a portion of the sludge is entrained with the flue gas. Up to 5–15% of the lime sludge can be recirculated in this way, which reduces the operational capacity of the rotary kiln, as well as having an adverse affect on the heat economy of the system. Adverse entrainment can also occur when lime sludge coming from a lime filter and having a very high dry solids content (80–90%) is fed directly to the kiln, or when lime sludge dust from the electric precipitator of the kiln is returned back to the kiln.

According to the present invention the problems associated with the prior art system have been overcome, resulting in enhanced heat economy and other advantageous operations of the rotary lime kiln. According to the invention the flow of lime sludge into the kiln first end is provided in a separate path than the flow of flue gases out of the kiln, so that contact between the lime sludge entering the kiln and flue gases exiting it is substantially prevented.

According to one aspect of the present invention a method of supplying lime sludge to a rotary kiln having a first end into which lime sludge to be burned is introduced, and from which flue gases from burning in the kiln are discharged, is provided. The method comprises the steps of: (a) Guiding the flow of lime sludge into the kiln first end in a first path. And, (b) guiding the flow of flue gases out of the kiln first end in a second path distinct from the first path so that contact between lime sludge entering the kiln and flue gases exiting the kiln is substantially prevented. Typically a substantially vertical flue gas conduit extends upwardly from the first end of the rotary kiln. There may be the further step, before step (a), of drying the lime sludge, utilizing any suitable or conventional technique.

While a wide variety of different mechanisms for guiding the flow of the lime sludge and the flow of the gases out of the kiln may be provided, such as baffles, valves, shrouds, and the like, preferably steps (a) and (b) are practiced by: (i) providing a generally horizontal tubular duct interiorly of the kiln first end and extending into the substantially vertical flue gas conduit, an annular chamber defined between an outer surface of the tubular duct and an inner surface of an inlet to the first end of the rotary kiln; and (ii) introducing the lime sludge into the annular chamber. Steps (a) and (b) may be further practiced by: (iii) providing spiral feeding blades on the outer surface of the tubular duct, and (iv) rotating the tubular duct with the rotary kiln so that the spiral feeding blades engage the lime sludge and move it toward the kiln. Substep (ii) may be practiced by: feeding wet lime sludge into the vertical flue gas conduit above the rotary kiln so that a significant amount of wet lime sludge is entrained by the flue gas flow, and the wet lime sludge is dried by the flue gas flow; separating the dried lime sludge from the flue gas flow; and transporting the separated dried lime sludge to the annular chamber for introduction into the annular chamber. Substep (ii) may be further practiced by causing some wet lime sludge to drop down into the vertical flue gas conduit adjacent the tubular duct, and mixing the wet lime sludge with the dried lime sludge using the spiral feeding blades.

The method may also comprise the further step of (c) causing any flue gases which enter the annular chamber to exit the annular chamber and flow into the substantially vertical flue gas conduit adjacent a bottom portion of the annular chamber. Step (c) may be practiced by providing a baffle at a top portion of the annular chamber adjacent the vertical flue gas conduit.

Substep (ii) may be practiced by introducing the lime sludge at a vertical position approximately at a vertical midpoint of the tubular duct. Step (b) may be further practiced by providing a portion of the tubular duct extending into the rotary kiln a distance of at least one meter to a remote end, and by tapering the tubular duct between the remote end and the substantially vertical flue gas conduit so as to improve guiding of the flue gas flowing through the tubular duct, and thus ensure that little or no flue gas passes into the annular chamber.

According to another aspect of the present invention apparatus for treating lime sludge is provided comprising the following components: A rotary lime-burning kiln having a first end into which lime sludge is introduced, and from which flue gases from burning lime sludge within the kiln are discharged. First means for guiding the flow of lime sludge into the kiln first end in a first path. And, second means for guiding the flow of flue gases out of the kiln first end in a second path distinct from the first path so that contact between lime sludge entering the kiln and flue gases exiting the kiln is substantially prevented.

The first and second means may comprise a generally horizontal tubular duct interiorly of the kiln first end, and extending into the substantially vertical flue gas conduit, with annular chamber defined between an outer surface of the tubular duct and an inner surface of the first end of the rotary kiln, and a conduit for introducing the lime sludge into the annular chamber. The apparatus may further comprise spiral feeding blades on the outer surface of the tubular duct; and means for rotating the tubular duct with the rotary kiln so that the spiral feeding blades engage lime sludge and move it toward said kiln. The apparatus may further comprise means for feeding wet lime sludge into the vertical flue gas conduit above the rotary kiln so that a significant amount of wet lime sludge is entrained by the flue gas flow, and the wet lime sludge is dried by the flue gas flow; means for separating the dried lime sludge from the flue gas flow; and means for transporting the separated dried lime sludge to the annular chamber for introduction into the annular chamber.

The apparatus may further comprise means—such as baffles, shrouds, screens, diverters, or the like—for causing any flue gases which enter the annular chamber to exit the annular chamber and flow into the substantially vertical flue gas conduit adjacent a bottom portion of the annular chamber. Preferably such causing means comprise a baffle at a top portion of the annular chamber adjacent vertical flue gas conduit. The conduit for introducing lime sludge into the annular chamber may comprise means for introducing the lime sludge at a vertical position approximately at a vertical mid-point of the tubular duct.

According to yet another aspect of the present invention a rotary lime kiln is provided. The lime kiln comprises: A hollow kiln body disposed at a slight incline to the horizontal, and having a first, higher, end, and a second, lower, end, the kiln body rotatable about a central axis having substantially the same slight incline to the horizontal. A tubular duct connected to the kiln body, interiorly thereof, for rotation therewith, the duct having a first duct end extending outwardly from the kiln first end, exteriorly thereof, and a second duct end located within the kiln body at least one meter (e.g. two meters) from the kiln first end. And, spiral feeding blades disposed on an outer surface of the duct at least on part of the first end thereof which extends outwardly from the kiln body first end, exteriorly of the kiln body. The tubular duct may be tapered between the first and second ends thereof, and have a conical portion which increases in diameter from closest the first end of the duct toward the second end of the duct. The kiln may further comprise a plurality of transport blades connected to the outer surface of the duct within the kiln body at least adjacent the conical portion.

It is the primary object of the present invention to provide a lime kiln, and a method and system for supplying lime sludge to a lime kiln, having enhanced heat economy and other advantages compared to conventional processes and equipment. This and other objects of the invention will become clear from an inspection of the detailed description of the invention and from the appended claims.

DETAILED DESCRIPTION OF THE DRAWINGS

Figure 1:
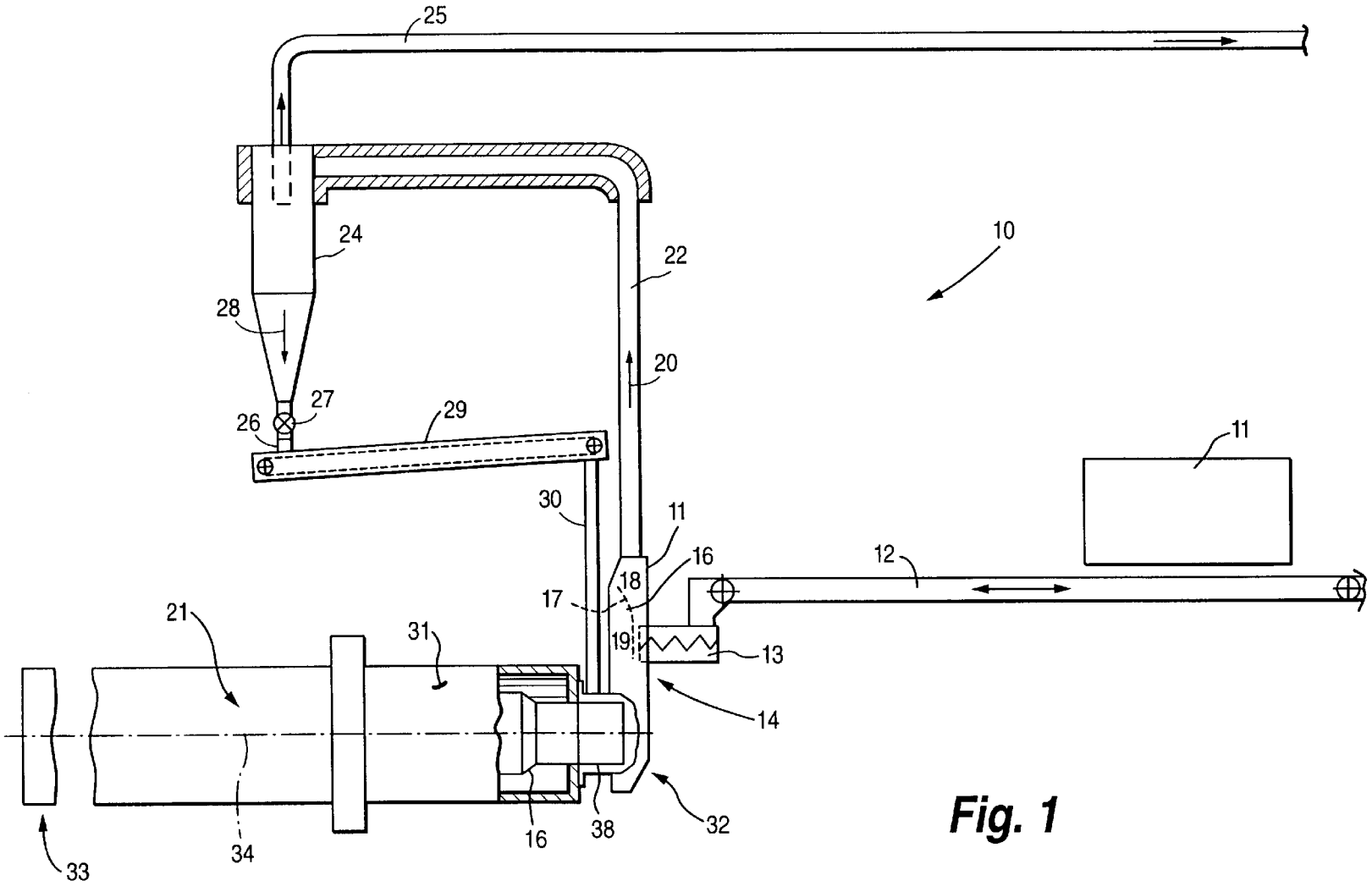
FIG. 1 is a side schematic view of an exemplary apparatus according to the present invention.

FIG. 1 shows and exemplary system for supplying lime sludge to a kiln generally in accordance with the disclosure of U.S. Pat. No. 5,213,496 but with the added features of the apparatus according to the present invention. The system of FIG. 1 is shown generally by reference numeral 10 and includes a conventional lime sludge filter 11 in which lime sludge produced in causticizing green liquor to produce white liquor in a pulp mill is thickened, and discharged so that it drops onto the top of the belt conveyor 12 or the like. The belt conveyor 12 feeds the lime sludge to a transport screw 13 which is connected to a generally vertical flue gas conduit 14. As perhaps best shown in FIG. 2, but also visible in FIG. 1, the conduit 14 (which typically has heat insulation 15) has a dividing partition 16 to which a control baffle 17 may be pivotally mounted. The partition wall 16 defines two flow channels for the flue gases, namely 18 and 19. By adjusting the position of the baffle 17, how much flue gas flows through each of the flow duct pathways 18, 19 can be controlled so as to control the amount of sludge which is entrained in upwardly flowing flue gases (20 in FIG. 2) or how much is discharged directly to the inlet to the rotary kiln 21, that is at the bottom of the conduit 14.

The upwardly flowing flue gases 20 entrain a significant portion of the sludge fed by the transport screw 13 into the conduit 14, and carry the sludge entrained therein into and through the drying conduit 22. The drying conduit 22 is connected to a conventional means for separating the entrained lime sludge particles from the flue gases. The separation means may comprise any suitable conventional structure, but preferably comprises a cyclonic separator 24 which has gas discharge 25 at the top thereof, and a bottom discharge 26 having a valve 27 therein. The particles pass downwardly, as indicated by arrow 28, from the separator 24 to a particle transporting conveyor (which may be a belt conveyor or any other suitable type of conveyor). From the conveyor 29 the dried sludge particles flow downwardly into a downwardly extending particle-conducting conduit 30. The conduit 30 introduces the lime sludge into the rotary kiln 21, as will be hereinafter described.

The kiln 21 includes a hollow kiln body 31 having a first end, shown generally by reference numeral 32, and a second end 33. The first end 32 is the inlet end for the lime sludge, and the discharge end for the flue gases, and typically is slightly higher than the second end 33. That is the kiln body 31 is preferably disposed at a slight incline to the horizontal (e.g. 2–10°), and rotates about a central axis 34 which has the same incline. The structure for rotating the kiln 21 is entirely conventional, and not shown in the drawings.

Figure 2:
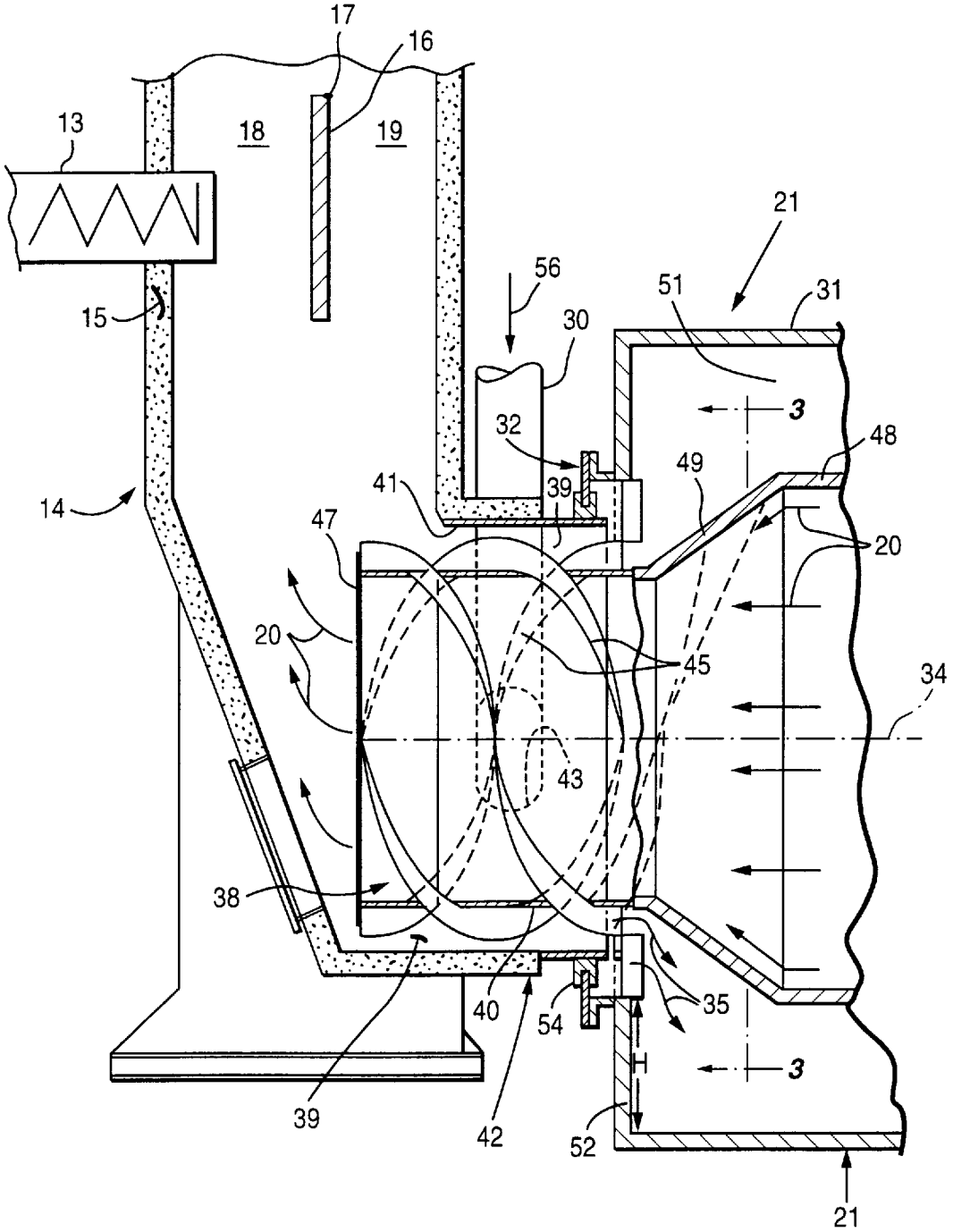
FIG. 2 is a side view, mostly in cross-section, but partly in elevation, of the rotary kiln exit and the generally vertical flue gas conduit bottom, for the system of FIG. 1.
Figure 3:
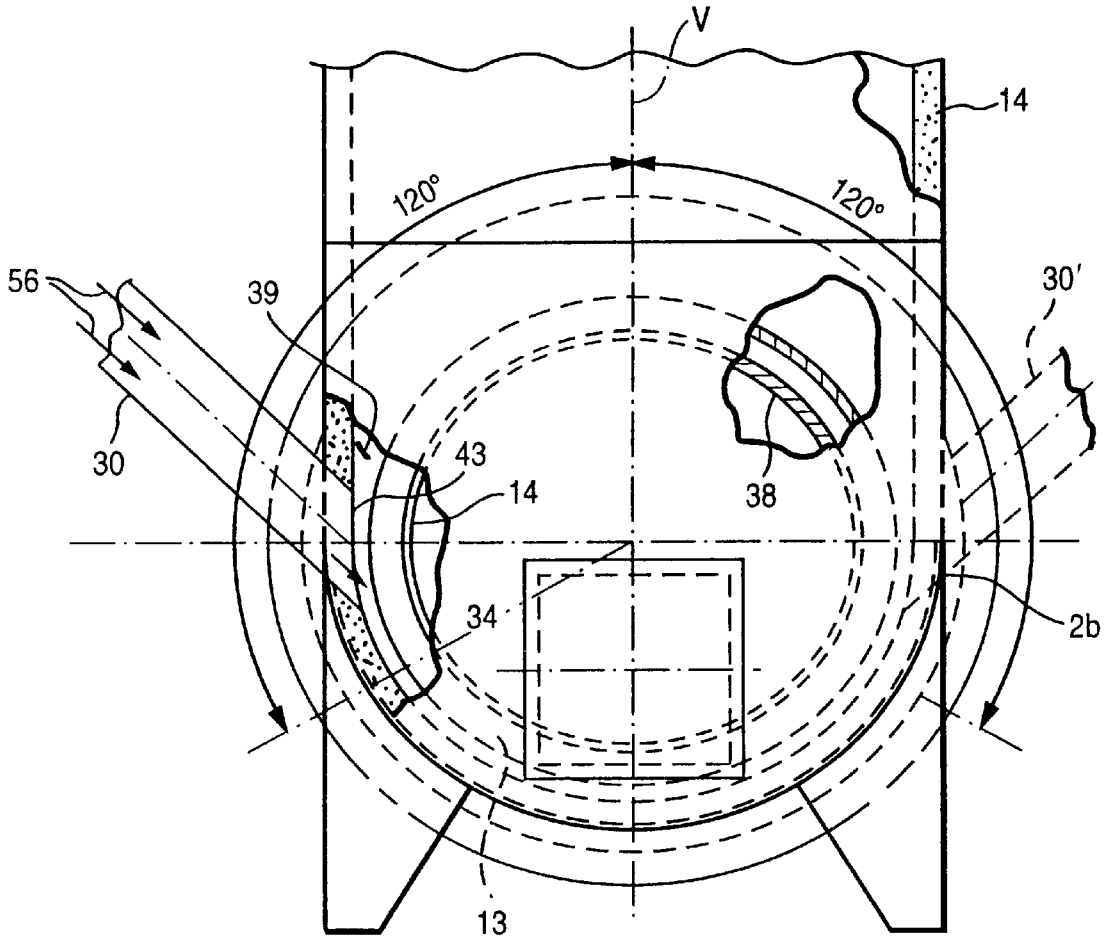
FIG. 3 is an end view, with portions cut away for clarity of illustration, of the apparatus of FIG. 1 looking toward the vertical flue gas conduit from the position of arrows 3—3 in FIG. 2.

The apparatus according to the present invention which results in the advantageous results desired is provided at the first end 32 of the rotary kiln 21, and can be seen in all of FIGS. 1 through 3, except that in FIG. 1 various elements are not illustrated simply for clarity of illustration.

The apparatus according to the present invention includes a first means for guiding the flow of lime sludge into the kiln 21 first end 32 in a first path, shown generally by arrow 35 in FIG. 2, and second means for guiding the flow of flue gases out of the kiln 21 first end 32 in a second path distinct from the first path so that contact between the sludge entering the kiln and flue gases exiting the kiln is substantially prevented. The flue gas path is shown generally by arrows 20 in FIG. 2. While the first and second means may comprise a wide variety of different structures, such as various baffles, screens, shrouds, and flow diverters, in the preferred embodiment illustrated in FIGS. 1 through 3 the first and second means comprise a generally horizontal (typically having the same incline as the kiln 21, that is being concentric with the axis 34) tubular duct 38 which is disposed interiorly of the first end 32 of the kiln body 31 and extends outwardly therefrom into the substantially vertical flue gas conduit 14. An annular chamber 39 (see FIG. 2) is defined between the outer surface 40 of the duct 38 and the inner surface 41 of an inlet 42 to the first end 32 of the kiln 21. The conduit 30 has an outlet opening 43 (see FIGS. 2 and 3) for introducing the lime sludge into the annular chamber 39.

While preferably a single conduit 30 is provided for introducing lime sludge, a plurality of such conduits can be provided, or an alternative position of the conduit may be provided, such as the alternative conduit 30' illustrated by dotted line in FIG. 3. Preferably the conduit 30, 30' introduces the lime sludge through the outlet 43 into the annular chamber 39 at a vertical position approximately at the vertical mid-point of the tubular duct 38 (that is at about the centerline 34), as is seen in both FIGS. 2 and 3.

Preferably the tubular duct 38, at least for the portion thereof extending outwardly from the rotary kiln 21, has a plurality of spiral feeding blades (not shown in FIG. 1 for clarity of illustration, but visible in FIG. 2 at 45). The spiral feeding blades 45 on the outer surface 40 of the tubular duct 38 (and perhaps continuing onto surface 49 of kiln 21) engage lime sludge introduced into the annular chamber 39 and, since the duct 38 is connected to the kiln body 31 for rotation therewith the blades 45 will move the sludge toward the kiln 21, flowing generally as indicated by arrows 35 in FIG. 2.

The duct 38 may be connected to the lime kiln 21, and the blades 45 to the duct 38 and/or lime kiln 21, by any suitable structure. In the preferred embodiment illustrated in FIG. 2, the duct 38 has a open first end 47 which extends into the conduit 14, and an open second end located a distance within the kiln 21 that preferably is at least about one meter from the first end 32 of the kiln 21. Preferably the duct 38 is tapered between the first and second ends, for example having a larger diameter portion 48 adjacent the second end, and a conical portion 49 which transitions between the first end 47 and the portion 48. As seen in FIG. 2 the conical portion 49 increases in diameter from closest the first end 47 toward the second end (that is portion 48) of the duct 38. This tapering action causes the flue gases flowing through the duct 38 to be positively guided as they exit the rotary kiln 21.

The conduit 38 preferably extends at least about 0.1 meter exteriorly of the first end 32. Preferably the duct 38 extends interiorly of the kiln 21 at least about one meter, e.g. between 1–2 meters.

The duct 38 may be secured to the kiln body 31 by any suitable mechanism. For example, a plurality of transport blades, typically three to eight transport blades, 51 (only one is shown in FIG. 2 for simplicity of illustration) are provided which extend between the duct 38 in the vicinity of the conical portion 49 and the interior wall of the body 31 (and/or the end wall 52 which defines the opening 32). The transport blades 51 engage the lime sludge flowing as indicated by arrows 35 into the interior of the kiln 21 as the kiln 21 is rotated, and move the lime sludge to a portion of the kiln 21 where it is burned.

By providing a construction according to the invention, as illustrated in FIGS. 1 through 3, the velocity of the gas flowing out of the kiln 21, as indicated by arrows 20, may be increased compared to conventional structures because the gas and lime sludge flow separately so that the gas does not contact the lime sludge as it is flowing into the kiln 21, or if there is any contact it is superficial and does not lead to any significant adverse consequences. Because of the higher gas velocity, the conduit 14 may be narrower than in a conventional kiln. The threshold height H (see FIG. 2) of the kiln is correspondingly higher, which reduces leakage to the inlet 39, which leakage normally occurs through the seal 54. Because of the higher threshold height H than in conventional lime kilns, if there is a build up of lime sludge adjacent the first end 32, the amount of time it takes before the lime sludge build up adversely affects the flow of the lime sludge into the kiln 21 is significantly extended.

While the introduction of the lime sludge into the annular chamber 39 preferably is in the direction indicated by the arrows 56 in FIGS. 2 and 3, the conduit or conduits 30, 30' may be rearranged so that the direction is substantially vertical, as indicated by the line V in FIG. 3. Preferably the point of introduction, even if not substantially at the height of the axis 34, is within one or both of the 120° arcs from the vertical line V illustrated in FIG. 3.

Figure 4:
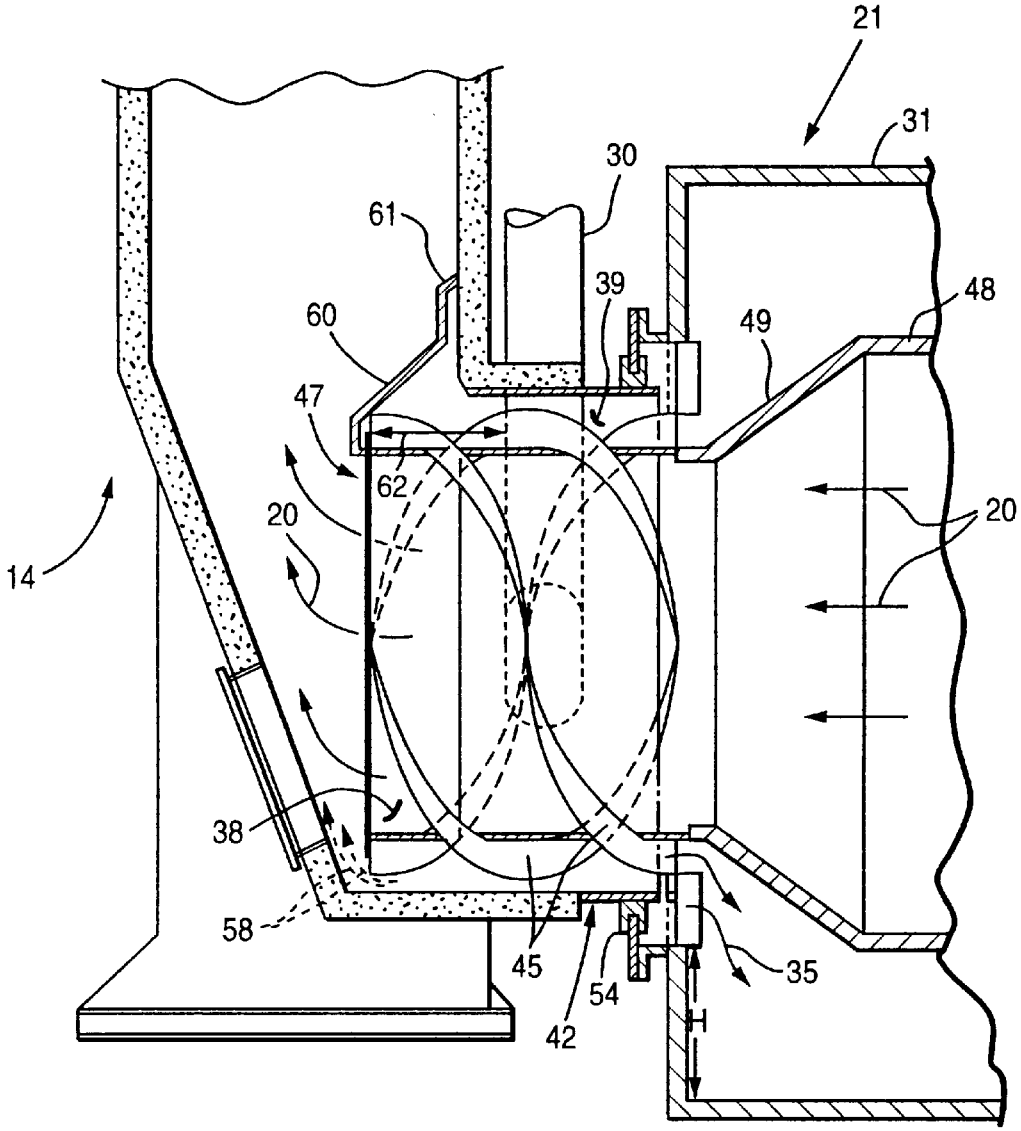
FIGS. 4 and 5 are views like that of FIG. 2 only showing alternative embodiments of apparatus according to the present invention.

FIG. 4 illustrates a first alternative embodiment of the apparatus according to the invention. In FIG. 4 components comparable to those in FIG. 2 are shown by the same reference numeral. The only major difference between the embodiment of FIG. 4 and that of the FIG. 2 is the provision in the FIG. 4 embodiment of means for causing any flue gas which enters the annular chamber 39 to exit the annular chamber 39 and flow into the vertical flue gas conduit 18 adjacent a bottom portion of the annular chamber 39, as illustrated by the arrows 58 in FIG. 4. This causing means preferably takes the form of a baffle 60 overhanging the tubular duct 38 at the first open end 47 thereof and connected via flange portion 61 to a wall surface of the conduit 14. The baffle 60 extends outwardly from the closest end of the lime sludge introducing conduit 30 into the conduit 14 a distance 62. The baffle 60 preferably has a semi-circular configuration so that it covers the top half of the duct 38, and so minimizes any disruption of the flow of lime sludge from the conduit 30 into the conduit 14.

Figure 5:
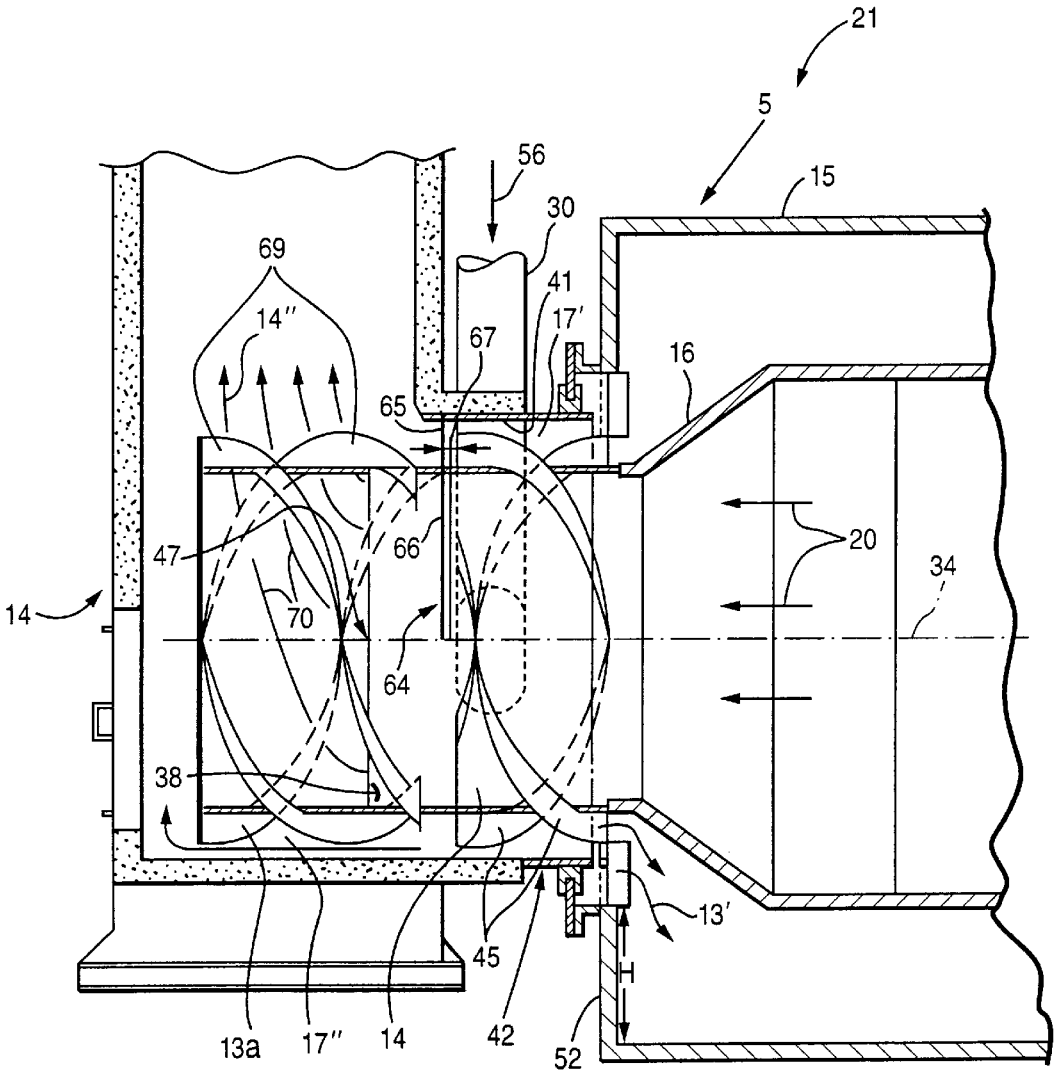

In FIG. 5 components comparable to those in the FIGS. 2 and 4 embodiments are shown by the same reference numeral. In the FIG. 5 embodiment, major differences are the shape of the bottom portion of the generally vertical flue gas conduit 14, the elongation of the duct 38 so that it extends further from the end wall 52 of the kiln 21, the configuration of the spiral feeding blades associated with the blades 45, and the provision of a different form of flow preventing baffle 64. The baffle 64 includes an upper portion 65 which extends downwardly from the inside wall 41 of the inlet 42, and a lower portion 66 which is forked and extends outwardly around the exterior of the duct 38 to approximately the axis 34. The baffle 64 is preferably spaced a distance 67 from the portion of the lime sludge supply conduit 30 that is closest to the conduit 14.

Because of the baffle 64, there must be an interruption in the spiral feeding blades. In the embodiment illustrated in FIG. 5 the spiral feeding blades 45 are only provided on the side of the baffle 66 that is closest to the kiln 21. On the other side of the baffle 64 from the kiln 21 are spiral feeding blades 69. Those blades are connected to the tubular duct 38 but extend outwardly further into the conduit 14 from the first end 47 of the duct 38 so that the blades 69 may effect mixing of any wet lime sludge which falls to the bottom of the conduit 14 when introduced by the transport screw 13. Since the volume and area between the blades 69 is open, the flue gas pathway 20 is essentially the same as in the FIGS. 2 and 4 embodiments.

While the use of the baffles 60, 64, or like flow directing structures is not absolutely necessary, the provision of such baffles 60, 64 does ensure that the flue gas flow from the kiln has as little influence as possible on the flow of the lime sludge through the conduit 30 into the kiln 21.

While the invention has been specifically described with respect to the use of the tubular duct 14, which results in countercurrent distinct substantially concentric pathways, other structures may be utilized. For example instead of a tubular duct, plate-like straight or conical partition walls (either stationary or rotatable with the kiln), or a stationary tubular duct comparable to the tubular duct 38 and mounted at the inlet 42, may be utilized as the first and second means for guiding the flow of lime sludge and flue gases. Alternatively, the construction may be rearranged so that the lime sludge is directed to the interior of a tubular duct like the duct 38 while the gas flow is exteriorly of that duct. The lime sludge that is supplied to the kiln 21 may include a mixture of wet lime sludge and lime sludge that has been dried by the suspension dryer provided by the components 14, 22, and/or the sludge introduced through the transport screw 13 may have been thickened to a very high dry solids content in the filter 11 and/or in a precipitator, e.g. to a dry solids content of about 90%, and a significant amount of the high dry solids content lime sludge may be allowed to fall directly to the bottom of the conduit 14. Also lime sludge dust separated from flue gases of a lime kiln in an electric precipitator may be supplied to the kiln 21 according to the invention.

As can be seen the method and apparatus according to the present invention is highly advantageous, substantially preventing circulation of material between the kiln and other flue gas treatment apparatus such as an electric filter, allowing the threshold height of the kiln to be increased thus reducing dust leakage through the glide seal, and allowing the utilization of a supply end structure which is lighter than in conventional kilns. While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for treating lime sludge, comprising:

a rotary lime-burning kiln having a first end into which lime sludge is introduced, and from which flue gases from burning lime sludge within the kiln are discharged, and a reaction zone remote from said first end, which lime burning takes place;

first means for guiding the flow of lime sludge into said kiln first end in a first path; and second means for guiding the flow of flue gases out of said kiln first end in a second path distinct from said first path so that contact between lime sludge entering said kiln and flue gases exiting said kiln is substantially prevented.

2. Apparatus as recited in claim 1 further comprising a substantially vertical flue gas conduit; and wherein said first and second means comprise a generally horizontal tubular duct interiorly of said kiln first end and extending into said substantially vertical flue gas conduit, an annular chamber defined between an outer surface of said tubular duct and an inner surface of an inlet said first end of said rotary kiln; and a conduit for introducing lime sludge into said annular chamber.

3. Apparatus for treating lime sludge, comprising:

a rotary lime-burning kiln having a first end into which lime sludge is introduced, and from which flue gases from burning lime sludge within the kiln are discharged;

first means for guiding the flow of lime sludge into said kiln first end in a first path;

second means for guiding the flow of flue gases out of said kiln first end in a second path distinct from said first path so that contact between lime sludge entering said kiln and flue gases exiting said kiln is substantially prevented;

a substantially vertical flue gas conduit; and wherein said first and second means comprise a generally horizontal tubular duct interiorly of said kiln first end and extending into said substantially vertical flue gas conduit, an annular chamber defined between an outer surface of said tubular duct and an inner surface of an inlet said first end of said rotary kiln; and a conduit for introducing lime sludge into said annular chamber.

4. Apparatus as recited in claim 3 further comprising spiral feeding blades on said outer surface of said tubular duct; and means for rotating said tubular duct with said rotary kiln so that said spiral feeding blades engage lime sludge and move it toward said kiln.

5. Apparatus as recited in claim 4 further comprising means for feeding wet lime sludge into said vertical flue gas conduit above said rotary kiln so that a significant amount of wet lime sludge is entrained by the flue gas flow, and the wet lime sludge is dried by the flue gas flow; means for separating the dried lime sludge from the flue gas flow; and means for transporting the separated dried lime sludge to said annular chamber for introduction into said annular chamber.

6. Apparatus as recited in claim 3 further comprising means for causing any flue gases which enter said annular chamber to exit said annular chamber and flow into said substantially vertical flue gas conduit adjacent a bottom portion of said annular chamber.

7. Apparatus as recited in claim 6 wherein said causing means comprises a baffle at a top portion of said annular chamber adjacent said vertical flue gas conduit.

8. Apparatus as recited in claim 3 wherein said conduit for introducing lime sludge into said annular chamber comprises means for introducing the lime sludge at a vertical position approximately at a vertical midpoint of said tubular duct.

9. A rotary lime kiln comprising:

a hollow kiln body disposed at a slight incline to the horizontal, and having a first, higher, end, and a second, lower, end, said kiln body rotatable about a central axis having substantially the same slight incline to the horizontal;

a tubular duct connected to said kiln body, interiorly thereof, for rotation therewith, said duct having a first duct end extending outwardly from said kiln first end, exteriorly thereof, and a second duct end located within said kiln body at least one meter from said kiln first end; and spiral feeding blades disposed on an outer surface of said duct at least on part of said first end thereof which extends outwardly from said kiln body first end, exteriorly of said kiln body.

10. A rotary kiln as recited in claim 9 wherein said tubular duct is tapered between said first and second ends thereof, having a conical portion which increases in diameter from closest said first end of said duct toward said second end of said duct; and further comprising a plurality of transport blades connected to said outer surface of said tubular duct within said kiln body at least adjacent said conical portion.

11. A method of supplying lime sludge to a rotary kiln having a first end into which lime sludge to be burned is introduced, and from which flue gases from lime burning in the kiln are discharged, the method comprising the steps of:

(a) guiding the flow of lime sludge into the kiln first end in a first path, so that the lime sludge enters the kiln and is burned therein; and (b) guiding the flow of flue gases out of the kiln first end in a second path distinct from the first path so that contact between lime sludge entering the kiln and flue gases exiting the kiln is substantially prevented.

12. A method as recited in claim 11 wherein a substantially vertical flue gas conduit extends upwardly from the first end of the rotary kiln; and wherein steps (a) and (b) are practiced by: (i) providing a generally horizontal tubular duct interiorly of the kiln first end and extending into the substantially vertical flue gas conduit, an annular chamber defined between an outer surface of the tubular duct and an inner surface of an inlet to the first end of the rotary kiln; and (ii) introducing the lime sludge into the annular chamber.

13. A method as recited in claim 11 comprising the further step, before step (a), of drying the lime sludge.

14. A method of supplying lime sludge to a rotary kiln having a first end into which lime sludge to be burned is introduced, and from which flue gases from burning in the kiln are discharged, the method comprising the steps of:

(a) guiding the flow of lime sludge into the kiln first end in a first path; and (b) guiding the flow of flue gases out of the kiln first end in a second path distinct from the first path so that contact between lime sludge entering the kiln and flue gases exiting the kiln is substantially prevented; wherein a substantially vertical flue gas conduit extends upwardly from the first end of the rotary kiln; and wherein steps (a) and (b) are practiced by: (i) providing a generally horizontal tubular duct interiorly of the kiln first end and extending into the substantially vertical flue gas conduit, an annular chamber defined between an outer surface of the tubular duct and an inner surface of an inlet to the first end of the rotary kiln; and (ii) introducing the lime sludge into the annular chamber.

15. A method as recited in claim 14 wherein steps (a) and (b) are further practiced by: (iii) providing spiral feeding blades on the outer surface of the tubular duct, and (iv) rotating the tubular duct with the rotary kiln so that the spiral feeding blades engage the lime sludge and move it toward the kiln.

16. A method as recited in claim 15 wherein substep (ii) is practiced by: feeding wet lime sludge into the vertical flue gas conduit above the rotary kiln so that a significant amount of wet lime sludge is entrained by the flue gas flow, and the wet lime sludge is dried by the flue gas flow; separating the dried lime sludge from the flue gas flow; and transporting the separated dried lime sludge to the annular chamber for introduction into the annular chamber.

17. A method as recited in claim 16 wherein substep (ii) is further practiced by causing some wet lime sludge to drop down into the vertical flue gas conduit adjacent the tubular duct, and mixing the wet lime sludge with the dried lime sludge using the spiral feeding blades.

18. A method as recited in claim 14 comprising the further step of (c) causing any flue gases which enter the annular chamber to exit the annular chamber and flow into the substantially vertical flue gas conduit adjacent a bottom portion of the annular chamber.

19. A method as recited in claim 18 wherein step (c) is practiced by providing a baffle at a top portion of the annular chamber adjacent the vertical flue gas conduit.

20. A method as recited in claim 14 wherein substep (ii) is practiced by introducing the lime sludge at a vertical position approximately at a vertical midpoint of the tubular duct.

21. A method as recited in claim 14 wherein step (b) is further practiced by providing a portion of the tubular duct extending into the rotary kiln a distance of at least one meter to a remote end, and by tapering the tubular duct between the remote end and the substantially vertical flue gas conduit.

22. A method as recited in claim 14 wherein substep (ii) is practiced by: feeding wet lime sludge into the vertical flue gas conduit above the rotary kiln so that a significant amount of wet lime sludge is entrained by the flue gas flow, and the wet lime sludge is dried by the flue gas flow; separating the dried lime sludge from the flue gas flow; and transporting the separated dried lime sludge to the annular chamber for introduction into the annular chamber.

* * * * *